US006463123B1

(12) United States Patent
Korenev

(10) Patent No.: US 6,463,123 B1
(45) Date of Patent: Oct. 8, 2002

(54) TARGET FOR PRODUCTION OF X-RAYS

(75) Inventor: Sergey Alexandrovich Korenev, Mundelein, IL (US)

(73) Assignee: Steris Inc., Temecula, CA (US)

( * ) Notice: Subject to any disclaimer, the term of this patent is extended or adjusted under 35 U.S.C. 154(b) by 0 days.

(21) Appl. No.: 09/710,745

(22) Filed: Nov. 9, 2000

(51) Int. Cl.[7] ..... G21K 5/00; G21K 5/10; G21G 4/00

(52) U.S. Cl. ..... 378/69; 378/64; 378/68; 378/119

(58) Field of Search ..... 378/64, 69, 68, 378/119, 121, 124, 143

(56) References Cited

U.S. PATENT DOCUMENTS

| | | | | | |
|---|---|---|---|---|---|
| 4,446,374 | A | * | 5/1984 | Ivanov et al. | 250/492.3 |
| 4,467,197 | A | | 8/1984 | Stieber | 250/305 |
| 4,484,341 | A | | 11/1984 | Luniewski | 378/69 |
| 4,763,344 | A | * | 8/1988 | Piestrup | 378/119 |
| 5,247,177 | A | | 9/1993 | Goldberg et al. | 250/358.1 |
| 5,259,012 | A | * | 11/1993 | Baker et al. | 378/21 |
| 5,396,074 | A | * | 3/1995 | Peck et al. | 250/453.11 |
| 5,401,973 | A | | 3/1995 | McKeown et al. | 250/492 |
| 5,451,794 | A | | 9/1995 | McKeown et al. | 250/492 |
| 5,635,714 | A | * | 6/1997 | Nablo et al. | 250/305 |
| 5,682,412 | A | * | 10/1997 | Skillicorn et al. | 378/98.6 |
| 5,994,706 | A | * | 11/1999 | Allen et al. | 250/454.11 |
| 6,294,791 | B1 | * | 9/2001 | Williams et al. | 250/455.11 |
| 6,327,339 | B1 | * | 12/2001 | Chung et al. | 378/121 |

FOREIGN PATENT DOCUMENTS

| | | |
|---|---|---|
| EP | 0 358 237 | 3/1990 |
| JP | 56-003956 | 1/1981 |
| JP | 07-056000 | 3/1995 |

* cited by examiner

*Primary Examiner*—Robert H. Kim
*Assistant Examiner*—Allen C. Ho
(74) *Attorney, Agent, or Firm*—Fay, Sharpe, Fagan, Minnich & McKee, LLP

(57) ABSTRACT

A source of electrons (10) generates a beam of free electrons which are accelerated through a vacuum chamber and collide with a target (34). The target has multiple layers of a high Z material such as tungsten or tantalum or for producing x-ray radiation when bombarded with high energy electrons. The target layers are located in sequence such that electrons that are not terminated in the first layer will pass to the second layer, and so on. This provides more efficient use of the generated electrons. The target layers are sandwiched between layers of a thermally conductive, low Z metal substrate (40), such as aluminum or copper or other material with a high thermal conductivity. Hollow passages (42) are bored in the substrate (40) to allow water or some other coolant to flow within them. As electrons strike the target (34), unwanted heat is generated along with the x-rays. The water carries the heat away from the target. As the passages are within the substrate, the water never comes into contact with the target material, and therefore, the life of the target is extended because oxidation and corrosion due to water exposure is inhibited.

19 Claims, 3 Drawing Sheets

TARGET FOR PRODUCTION OF X-RAYS

BACKGROUND OF THE INVENTION

The present invention relates to the irradiation arts. It finds particular application in the field of product sterilization, disinfection, and radiation treatment and will be described with particular reference thereto. However, the present invention is applicable to a wide variety of other applications including, but not limited to, food and spice treatment, plastics modification, x-ray imaging, genetic modification, and other fields in which controlled doses of radiation are advantageous.

Products are typically irradiated by being conveyed past a radiation source, such as cobalt rods, electron beam accelerators, or x-ray sources. Cobalt rods are effective, but cannot be turned off for maintenance in the treatment vault. Rather, they are mechanically immersed in heavy water. Spent cobalt rods are changed and stored deep in the heavy water. Accelerated electron beams are easy to control, but have limited penetration power relative to x-ray or γ-ray radiation.

X-rays are high energy photons that are produced as a result of accelerated electrons interacting with a target. Typically, metals such as tungsten or tantalum are used. To produce x-rays, free electrons are generated, such as by being boiled off of a filament. The electrons are accelerated in a vacuum through a potential to a desired kinetic energy toward the metal target. The accelerated electrons interact with the electrons naturally present in the target metal. As the electrons interact, some of the kinetic energy of the incoming electrons is transferred into the electrons of the target metal perturbing them into higher energy states. Over time these electrons decay back to their lower energy states releasing energy in the form of x-rays.

X-rays have been found to be very useful in the sterilization of products. This type of high energy radiation, in sufficient doses, kills most all types of living organisms. This includes parasitic bacteria and viruses which have the potential of making people ill. This is useful for sterilizing food meant for consumption, as well as other products such as medical instruments. Of course there is no chance of residual radiation with x-rays, so the product is safe afterwards, and will not harm the consumer as a result of being irradiated.

One of the biggest problems with x-ray production is that not all of the energy of the incoming electrons is converted into x-rays in this manner. The majority of the energy is lost to non-useful collisions and converted into heat. Typically, the best systems convert approximately 15% of the kinetic energy of the incoming electrons into x-rays, i.e. approximately 85% of the energy is converted into heat. This amount of heat is sufficient to destroy or damage the target. In order to conserve the integrity of the target, and thus, the system, sufficient heat is removed to maintain the target below a preselected maximum temperature.

Different types of cooling systems are employed. Relative movement between the electron beam and the target permits heated spots of the target to cool between electron beam irradiations. In high energy applications, the electron beam returns before cooling is complete and heat builds to target damaging levels. Some x-ray systems have a fluid coolant that flows over the target, transferring the produced heat away from the target. Problems with this type of system are low efficiency of the cooling system and short life of the target. Typically, the fluid used is water which flows over the metal target. Over time and extreme stress, the target corrodes.

The present invention presents a new method and apparatus that overcomes the above referenced problems and others.

SUMMARY OF THE INVENTION

In accordance with one aspect of the present invention, a product irradiation device is given. Products to be irradiated are propagated upon a conveyer which passes through a region that is irradiated by x-rays converted by a target from high energy electrons accelerated from an accelerator. A radiation shield protects the area and a control room from ambient radiation. The target of the preferred embodiment is a multi-layered tantalum assembly, sandwiched between layers of thermally conductive substrate. A coolant system draws heat generated by the target away from the substrate.

According to a more limited aspect of the invention, an optical sensor detects when product is present in the region and only allows the accelerator to release electrons when there is product in the region.

According to another aspect of the present invention, a product irradiation system is provided including an accelerator, a product conveyer, and an x-ray anode for the production of x-rays as a result of electrons generated from the accelerator striking it.

According to another aspect of the present invention, a method of x-ray production is provided where electrons encounter multiple layers of target material and are converted multiple spectra of x-rays.

According to another aspect of the present invention, an x-ray target is given made of layers of high Z material sandwiched between layers of thermally conductive low Z material which allow the propagation of heat away from the high Z material.

One advantage of the present invention is that it produces x-rays efficiently.

Another advantage of the present invention is that anode life is extended.

Another advantage of the present invention is that coolant corrosion of the target is eliminated.

Yet another advantage of the present invention resides in reduced heating.

Still further benefits and advantages of the present invention will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENT

Figure 1:
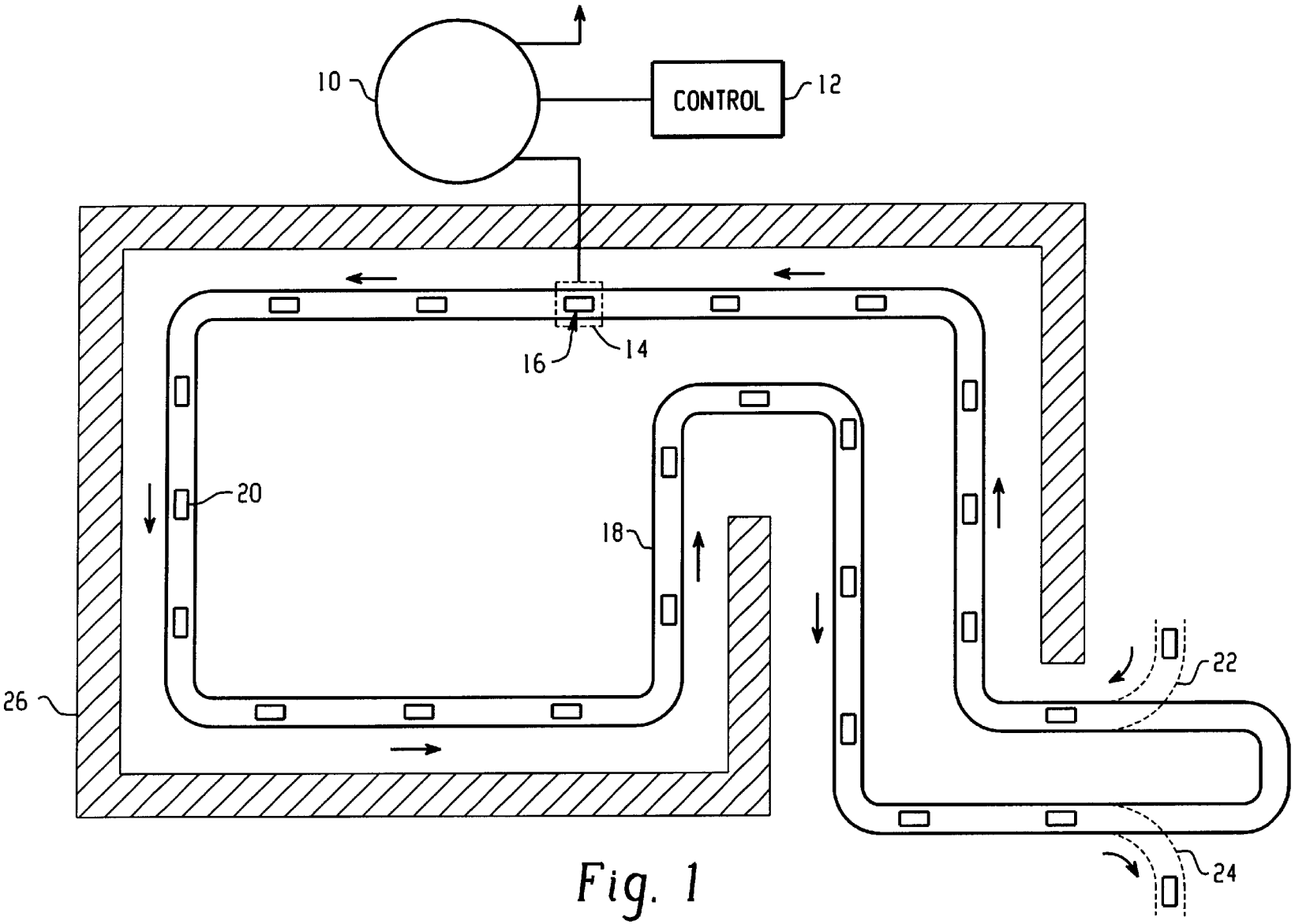
FIG. 1 is an overhead view of a product treatment system in accordance with the present invention.

With reference to FIG. 1, an electron accelerator 10 produces high energy electrons. In the preferred embodiment, the electron accelerator 10 generates electrons with potentials of 1 to 10 MeV. The accelerator 10 is controlled from a remote control room 12 where an operator manipulates variables such as the potential of the electrons, the destination of the electrons, and the like. The electrons from one accelerator are selectively directed to various treatment areas. The electrons are directed to an x-ray producing device 14 where they are converted into x-rays for use in a product sterilization or other treatment process. The produced x-rays irradiate a region 16, through which a product conveyer 18 conveys packages of product 20 to be sterilized or treated.

An entry gate 22 controls the rate of entry of product onto the conveyer 18. This allows the product conveyer 18 to be operated at different speeds relative to other conveyers that bring product to and from the product conveyer 18 depending on the application. For products that need more irradiation, the conveyer 18 is run at a slower speed, if appropriate. Likewise, the conveyer 18 is accelerated, if appropriate, for product that needs less irradiation.

In an alternate embodiment, the product conveyer always runs at a constant speed and the radiation intensity, and therefore the dose is changed. This embodiment varies the amount of radiation transmitted into the treatment region 16 as a result of more intense radiation.

An exit gate 24 channels irradiated product onto another conveyer for removal from the system. This further allows the product conveyer to be operated independently of its surroundings. For safety purposes most of the conveyer 18 is within a radiation shield 26 which allows no ambient radiation to exit.

The gates 22, 24 can be toggled in the preferred embodiment to allow product 20 to be irradiated multiple times if desired. For example, the product can be irradiated once from each side before being discharged and replaced.

Figure 2:
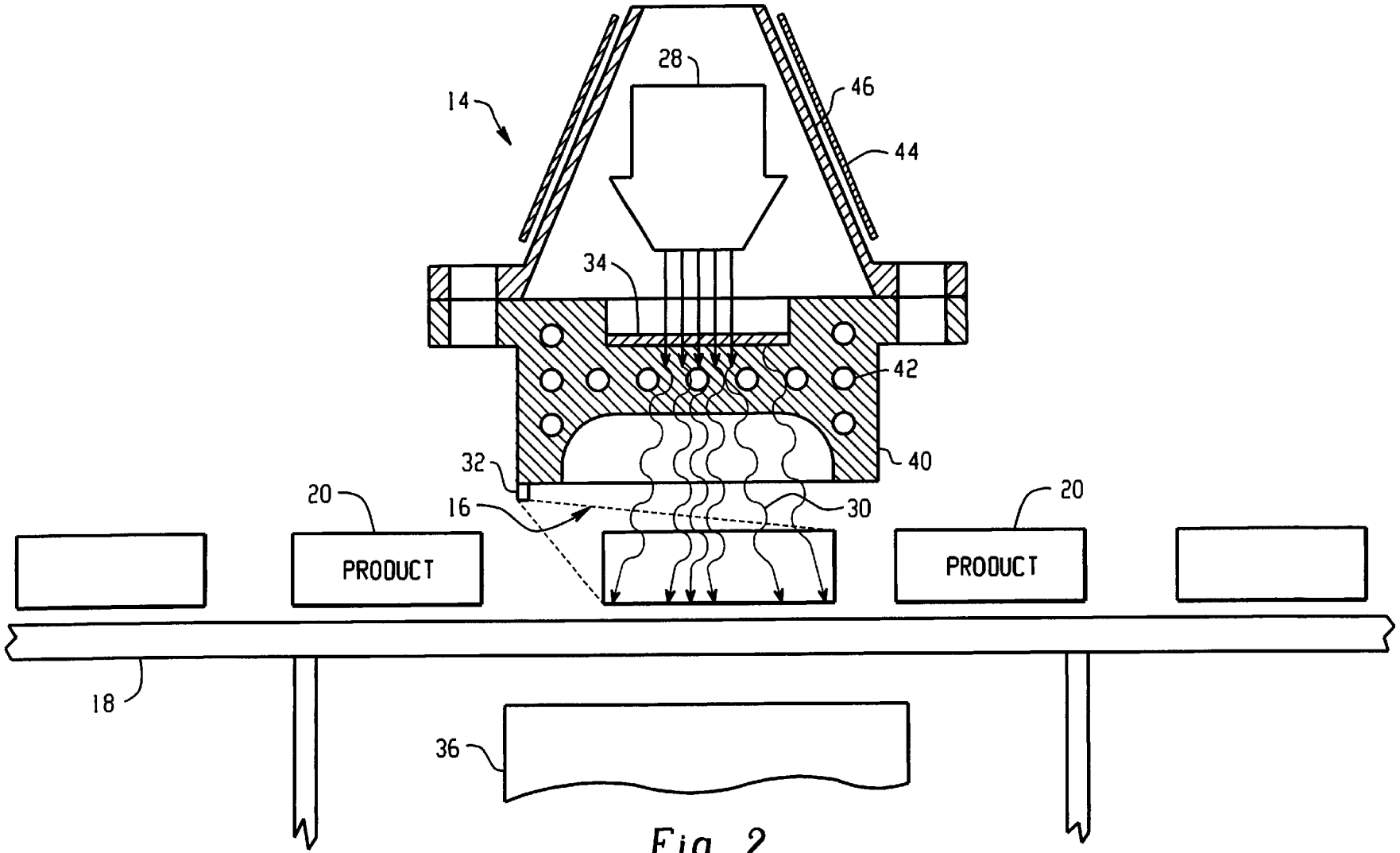
FIG. 2 is a more detailed view in partial section of a radiation generation region of the system of FIG. 1.

With reference to FIG. 2 and continuing reference to FIG. 1, a high energy electron beam 28 generated by the accelerator 10 is converted into x-rays 30. These x-rays 30 irradiate the product 20 which is passing on the conveyer 18. In the preferred embodiment, there is an optical or other sensor 32 that senses when the product 20 is in the treatment region 16. The optical senor 32 is coordinated with the electron accelerator control 12 such that the treatment region 16 is only irradiated when there is product 20 present.

The optical sensor 32 helps extend the life of a target 34. When the x-ray source 14 is in operation, it is constantly generating heat, and is constantly cooled. By toggling the source 14 on and off, while still cooling it, the target 34 cools down more efficiently.

As an option, a shield 36 made of heavy metal, such as lead or iron, is disposed behind the conveyer 18 opposite the x-ray source. This shield terminates most of the radiation that has passed through the product 20 and the conveyer 18, making the surrounding area safer. The shield 36 is preferred when the beam is directed horizontally or the installation is not on the ground floor, to protect the rooms next to or below the x-ray source.

Figure 3:
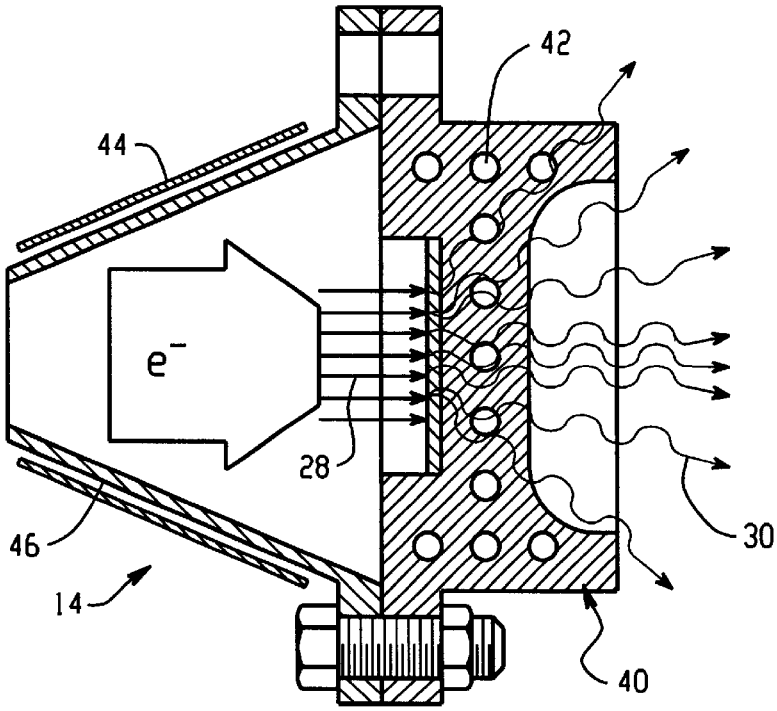
FIG. 3 is a side sectional view of a scan horn and an x-ray generating apparatus in accordance with the present invention.

With reference to FIG. 3 and continuing reference to FIG. 2, the x-ray source target 34 is made of metal that is capable of producing x-rays when bombarded with high energy electrons. In the preferred embodiment, the target 34 is made of tantalum mounted to a substrate 40 having high thermal conductivity. Aluminum, copper, and their alloys are preferred, but other thermally conductive materials are also contemplated. When electrons cross a vacuum and hit the target 34, much of their energy is converted into heat. The conductive substrate 40 conducts the heat away from the target 34. Coolant fluid, water in the preferred embodiment for simplicity of handling, flows through tubes, bores, or other cavities 42 in the substrate to conduct heat away from the system. Other fluids, such as coolant oil are also contemplated.

Preferably, the coolant fluid does not come into direct contact with the target 34. Because of this, the target is protected from oxidation and corrosion as a result of exposure to the coolant. Alternately, the coolant could flow directly over the target 34. Preferably corrosion inhibitors are added to reduce corrosion and extend the life of the target.

The x-ray source 14 includes deflection plates 44 located along a periphery of an accelerator horn 46. The deflection plates 44 electrostatically or magnetically manipulate a direction of the electron beam 28 such that the electron beam 28 does not always hit the same spot on the target 34. More specifically, the control 12 controls the deflection plates in accordance with dimensions of the product. Typically, the scan horn is elongated, for example, about a meter long. The electron beam is swept back and forth over a distance commensurate with the corresponding dimension of the passing product. To promote cooling of the target, the electron beam is also moved side to side. For example, the electron beam is swept along one line in a first sweep and along a parallel line on the return sweep. More complex sweep patterns such as following a multiplicity of parallel, shifted sweep paths, sinusoidal or other non-linear sweep paths, oval loops, and other two dimensional paths are also contemplated.

In the preferred embodiment, the deflection plates 44 are electrostatic plates which, when negatively charged, repel the electron beam. Positively charged plates to attract the beam are also contemplated. Alternately, they may be magnetic plates. The plates can be located inside or outside of the vacuum. If electrostatic plates are located inside the vacuum, hermetic feedthroughs for electrical leads are provided.

Figure 4:
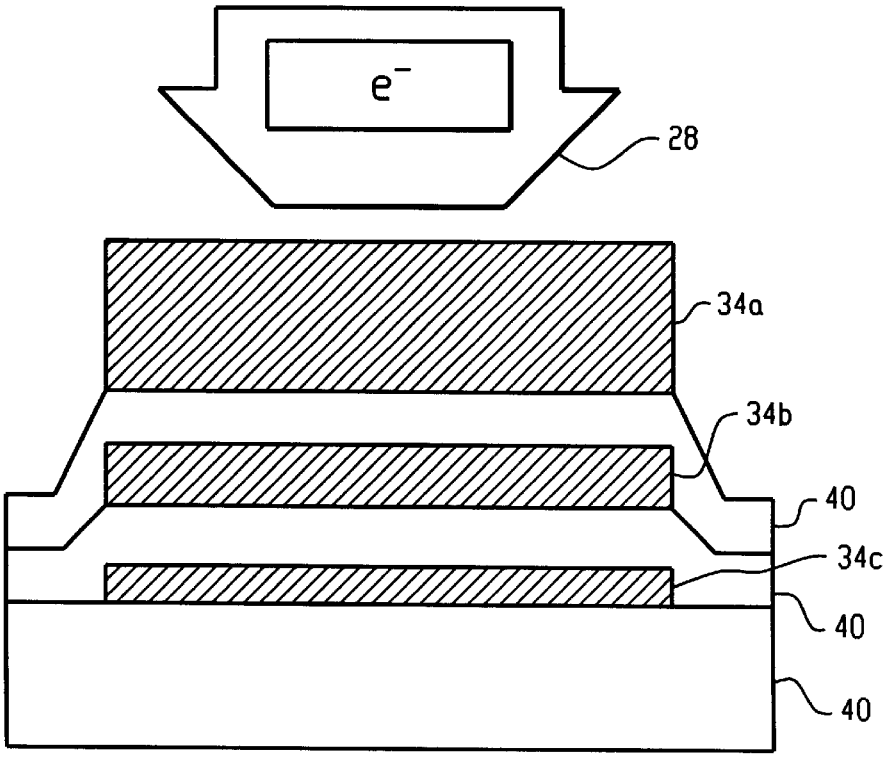
FIG. 4 is a detailed view of a target of the x-ray producing apparatus of FIG. 3.

With reference to FIG. 4, a detailed view of a preferred target 34 is provided. The target 34 is divided into multiple layers, three in the preferred embodiment. The target layers are sandwiched between by layers of the thermally conductive substrate 40. When the x-ray source 14 of the preferred embodiment is in operation, the electron beam 28 strikes a first layer 34*a* of tantalum foil. Some of the electrons are converted into x-rays and some pass through the first layer of target. Those electrons which pass through strike a second layer 34*b* of target, where some are converted and some pass through. The process is again repeated for a third layer 34*c*.

The target layers in the preferred embodiment are films or coatings of the target material adhered to layers of substrate material. As illustrated in FIG. 4, the target layers 34*a*, 34*b*, 34*c* are progressively thinner.

Each layer has a different capability of stopping electrons. Typically, different energies are stopped in different layers. As a result, different x-ray spectra result from each layer. Further, the second and third layers filter out low energy x-rays generated in the upstream target layers. This is an advantage of having multiple layers of target as opposed to one thick layer of target. It is to be understood that the x-rays generated in the preferred embodiment have a direction of propagation that is generally the same as the electron beam.

To help focus the x-rays in a forward direction, the substrate is shaped with forward extending side flanges. The greater material thickness at the flanges absorbs more x-rays than the thinner central window portion. Optionally, a layer of filter material, such as stainless steel, is positioned between one or more target layers and the treatment region to absorb low energy x-rays.

Typically, the best conventional x-ray targets only convert approximately 15% of the kinetic energy of the incumbent electrons into x-rays. The target 34 of the present invention converts about 80% of the electrons' energy into x-rays. This is done by supporting a very wide variety of energies in the target. What would not get used in a conventional target, passes through the first layer 34*a* and interacts with the second, and so on. Since more of the electrons are being used, less are being converted into heat. This makes cooling the target a somewhat easier proposition.

In an alternate embodiment, one thick layer of target could be used instead of multiple thinner ones and achieve the same electron stopping power. Because common target materials, such as tantalum and tungsten are relatively poor heat conductors, the heat from the anode target is removed more slowly.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A product irradiation device comprising:

an electron accelerator that supplies accelerated electrons;

a multi-layered target upon which the accelerated electrons generated by the accelerator impinge and lose kinetic energy, some of the kinetic energy being converted into x-rays;

a radiation shield that protects areas surrounding an x-ray treatment region from stray radiation;

a product conveyer upon which a product is propagated through the treatment region at a selected speed;

an operator accessible control system that coordinates the operation of the electron accelerator, the product conveyer, and the coolant system.

2. The product irradiation device as set forth in claim 1, wherein the x-ray source further includes a thermally conductive substrate divided into multiple layers and interleaved between the multi-layered target.

3. The product irradiation device as set forth in claim 2, wherein the target layers are coatings of target material upon the substrate.

4. The product irradiation device as set forth in claim 1, wherein the target includes layers of tantalum or tungsten foil.

5. The product irradiation device as set forth in claim 1, wherein the source of x-rays further includes:

an evacuated chamber through which the electrons travel after leaving the source of electrons, before impinging upon the target.

6. The product irradiation device as set forth in claim 5, wherein the source of x-rays further includes:

deflective elements on the periphery of the evacuated chamber for manipulating a direction of propagation of the electrons, thereby temporally varying a spot upon the target upon which the electrons are incident.

7. The product irradiation device as set forth in claim 1, wherein the multi-layered target comprises:

a first target layer which produce s a first x-ray spectrum as a result of interactions with electrons from the electron source;

a second target layer which produces a second x-ray spectrum as a result of interactions with electrons from the electron source; and, a third target layer which produces a third x-ray spectrum as a result of interactions with electrons from the electron source.

8. The product irradiation device as set forth in claim 1, further including:

an optical sensing device that senses when a product is and is not in the sterilization region and directs the electron accelerator to only emit electrons when there is product in the sterilization region.

9. A product irradiation device comprising:

a source of radiation that emits x-rays into a treatment region, the source of radiation including:

a plurality of target layers which convert accelerated electrons into x-rays;

a plurality of thermally conductive layers interleaved between the target layers, cavities being defined through the conductive layers through which the coolant fluid flows to draw heat away from the target layers;

an electron accelerator that supplies the accelerated electrons and electron acceleration potentials to the source of x-rays;

a coolant system which pumps a coolant fluid from a remote location through the conductive layer cavities to cool the source of radiation;

a radiation shield that protects surrounding areas from stray radiation;

a product conveyer upon which a product is propagated through the treatment region at a selected speed;

an operator control that coordinates the operation of the electron accelerator and the product conveyer.

10. The product irradiation device as set forth in claim 9, wherein the coolant fluid is water.

11. A product irradiation system comprising:

a conveyor which conveys products past a scan horn;

an electron accelerator which accelerates electrons to at least 1 MeV;

an evacuated path which conveys the accelerated electrons to the scan horn;

an electron sweeping system which sweeps the accelerated electrons across the scan horn;

a face plate on the scan horn of thermally conductive, lower Z material, coolant fluid channels being defined in the face plate; and, an anode target of a higher Z material than the face plate mounted to the face plate to convert the accelerated electrons into x-rays for irradiation of the products and into heat, coolant in the face plate coolant channels removing the heat.

12. The product irradiation system as set forth in claim 11, wherein the electron sweeping system sweeps the electrons transversely and longitudinally across the target.

13. A product irradiation system comprising:

an electron accelerator which accelerates electrons to at least 1 MeV;

a target on the scan horn including a plurality of layers of high Z metal interleaved with layers of thermally conductive low Z metal, the high Z metal converting the accelerated electrons into x-rays and heat and the thermally conductive low Z metal conducting the heat from the high Z metal;

an electron sweeping system which sweeps the accelerated electrons across the target;

a conveyor which conveys products through the x-rays.

14. A method of x-ray production comprising:

generating and accelerating an electron beam;

striking a first layer of a target with the electron beam converting a first portion of the electrons into x-rays of a first energy spectrum, a second portion of the electrons passing through the first target layer;

striking with the second portion of electrons a second layer of target, converting a third portion of the electrons into x-rays of a second energy spectrum, a fourth portion of the electrons passing through the second target layer; and, conducting heat through thermally conductive layers sandwiched between the target layers.

15. The method as set forth in claim 14, further including:

striking at least one additional target layer with electrons that passed through the second target layer producing x-rays of a third energy spectrum.

16. A method of x-ray production comprising:

generating and accelerating an electron beam;

striking a first layer of a target with the electron beam converting a first portion of the electrons into x-rays of a first energy spectrum, a second portion of the electrons passing through the first target layer;

striking with the second portion of electrons a second layer of target, converting at least part of the second portion of the electrons into x-rays of a second energy spectrum; and, dissipating heat generated in the target by:

conducting heat through thermally conductive layers sandwiched between the target layers;

running a cooling fluid through thermally conductive material connected to the thermally conductive layers.

17. An x-ray target for closing an evacuated chamber through which high energy electrons travel, the target comprising:

multiple layers of high Z target material; and, multiple layers of thermally conductive low Z substrate interleaved between the target layers.

18. The x-ray target as set forth in claim 17, further including cavities remote from the target layers through which a coolant fluid flows to draw heat from the low Z substrate layers, without physically contacting the target.

19. The x-ray target as set forth in claim 17 further including:

deflecting plates located adjacent the periphery of the evacuated chamber for manipulating the path of the electron beam in two dimensions.

* * * * *